United States Patent [19]

Lewis

[11] Patent Number: 4,474,121

[45] Date of Patent: Oct. 2, 1984

[54] FURNACE CONTROL METHOD

[75] Inventor: Frederick M. Lewis, Mountain View, Calif.

[73] Assignee: Sterling Drug Inc., New York, N.Y.

[21] Appl. No.: 333,102

[22] Filed: Dec. 21, 1981

[51] Int. Cl.[3] ..... F23G 7/06

[52] U.S. Cl. ..... 110/346; 110/188; 110/210; 236/15 E; 431/76

[58] Field of Search ..... 110/186, 188, 210, 211, 110/212; 431/76, 12; 236/15 BD, 15 E

[56] References Cited

U.S. PATENT DOCUMENTS

| | | | |
|---|---|---|---|
| 2,569,530 | 10/1951 | Kramer et al. . | |
| 3,964,676 | 6/1976 | Rooks et al. . | |
| 4,013,023 | 3/1977 | Lombana et al. | 110/187 |
| 4,050,389 | 9/1977 | von Dreusche | 110/190 |
| 4,106,690 | 8/1978 | Tomlinson . | |
| 4,145,979 | 3/1979 | Lilley et al. | 110/210 |
| 4,156,502 | 5/1979 | Day . | |
| 4,162,889 | 7/1979 | Shigemura | 431/76 |
| 4,172,555 | 10/1979 | Levine . | |
| 4,174,807 | 11/1979 | Smith et al. . | |
| 4,182,246 | 1/1980 | Lombana et al. | 110/188 |
| 4,332,206 | 6/1982 | Tucker et al. | 110/212 |

*Primary Examiner*—Henry C. Yuen
*Assistant Examiner*—Steven E. Warner
*Attorney, Agent, or Firm*—Allen H. Erickson; Thomas L. Johnson; B. Woodrow Wyatt

[57] ABSTRACT

A method for controlling two-stage combustion furnaces having a first stage operated with sub-stoichiometric airflow and a second stage operated with excess air, whereby the first stage airflow is controlled such that the ratio of first stage airflow to total airflow is maintained less than $$\frac{100\,N}{100 + \text{Percent Excess Air To Furnace}}$$

where N lies between zero and unity.

5 Claims, 2 Drawing Figures

FURNACE CONTROL METHOD

BACKGROUND OF THE INVENTION

1. Field of the Invention

The present invention relates to a method for controlling two-stage combustion furnaces having a first stage operated at a sub-stoichiometric air flow rate and a second stage operated with excess air.

2. Description of the Prior Art

Two-stage combustion is an old art which has found increasing use in the pyro-processing of sewage sludges, solid wastes and other combustible materials. In this process, combustible materials are partially combusted in a first stage to produce combustible gases as well as ash. The gases are consumed in the second stage, often called an afterburner, with an excess of air.

Air is typically supplied to the first stage known as a primary combustion chamber, at a rate which is substoichiometric with respect to the oxygen demand of the combustible material. This is commonly known as starved-air combustion.

A substantial portion of the combustion takes place in the second stage known as the secondary combustion chamber. The combustion is carried out with an excess of air present in order to ensure essentially complete oxidation of the combustible gases and meet government discharge regulations. Secondary combustion chambers are typically operated with air rates of 50–200 percent in excess of the stoichiometric air requirement.

Combustible materials processed in the two-stage furnace are nearly completely gasified to fuel gases and/or oxidized in the primary combustion chamber. The remaining "ash" discharged therefrom is thus composed of primarily inorganic solids.

The term "pyrolysis" is widely used as a synonym for "starved-air" or "two-stage" combustion. Strictly speaking, "pyrolysis" implies heating in the absence of oxygen. Both pyrolytic and oxidative reactions are promoted in the first stage and the second stage is highly oxidative. As already indicated, these two-stage furnaces are typicaly operated with an overall superstoichiometric air rate.

Various types of furnace designs may be used in the two-stage mode; the most popular have a primary combustion chamber of multiple hearth or Herreshoff design.

The control of two-stage combustion systems is typified by U.S. Pat. Nos. 4,013,023 and 4,182,246, in which the quantity of air fed to the hearths of the primary combustion chamber is controlled by hearth temperatures such that the airflow rate is caused to i.e., decrease as hearth temperatures increase. This is called reverse action control. Likewise, the flow rate of auxiliary fuel to burners in the first stage is also decreased to effect a temperature reduction. An oxygen monitor measures residual oxygen in the vapors passing to the second stage and places constraints upon the effect of high or low first-stage temperatures upon regulated air flow and burner operation.

In U.S. Pat. Nos. 4,013,023 and 4,182,246 the air rate and auxiliary fuel rate to the second stage are varied to achieve the desired temperature. As indicated previously, the secondary air rate must be in excess of the stoichiometric requirement for complete combustion in order to meet air pollution standards. This air rate is controlled by the temperature such that air is increased at increasing temperatures in order to quench and cool the burning gases. This is termed direct mode control. An oxygen sensor measures the oxygen concentration in the flue gas from the second stage and increases the air rate thereto whenever the oxygen value falls below a preselected low limit.

For a given furnace processing a given combustible material, a particular adiabatic flame temperature can be achieved at two different air rates, one sub-stoichiometric and one greater than stoichiometric. While a single operating temperature is possible when the airflow is exactly stoichiometric, it is not desirable nor even practical to operate a furnace at that point.

In many two-stage systems, normal variations in feed rate or feed moisture of the combustible materials may temporarily change the first stage from substoichiometric air operation to excess air (superstoichiometric) operation. For example, a sudden increase in feed moisture content may reduce the first-stage temperature to a point at which combustion cannot be maintained, even with the auxiliary burners. Under reverse-action control, the air rate will increase rather than decrease, further cooling the first stage. Thus the controller is incapable of maintaining the desired substoichiometric operation, because there are two possible air rates which may result in the same adiabatic flame temperature. At the indicated temperature the airflow may be either substoichiometric or superstoichiometric.

It is possible to sample the gases from the first stage to determine their combustibles content. This will indicate whether the first stage is operating with substoichiometric airflow. Unfortunately, gases from a sub-stoichiometric combustion chamber also contain tars, oils and soot which tend to foul analytical instruments. These materials may be removed by cumbersome procedures; such cleanup removes combustible matter from the gases and gives erroneous analyses. Determination of oxygen content of the gases leaving the first stage presents similar problems.

U.S. Pat. No. 4,050,389 shows a multiple hearth furnace controlled so that it may continuously change from excess air operation to starved-air operation, and vice versa, as waste material fed to the furnace changes in character.

The principal object of the present invention is to enhance control of a two-stage furnace such that the first stage is always operating in a starved-air mode and the second stage is always operating with excess air, regardless of variations in feed rates and thermal values of the combustible matter.

A further objective is to accomplish the control using only the measurements of i.e., temperature, oxygen, etc. which are already commonly required to perform the temperature control of the individual stages.

A further object is to eliminate the need for direct measurement of oxygen or combustibles content of the gases and vapors passing from the first combustion stage to the second stage. At this point, the gases contain tars, oils and soot which foul analytical instruments unless such materials are previously removed from the gases. When such gases are cleaned by removing combustible solids, the analysis of total combustibles in inaccurate. Likewise, accurate measurement of oxygen concentration in the gases requires cleaning of the gas in a manner which will remove none of the oxygen present.

SUMMARY OF THE INVENTION

This invention relates to control of two-stage combustion furnaces used for incineration of sewage sludge, solid wastes and other combustible material.

In these furnaces, the first stage is operated under substoichiometric air quantities and the second stage combusts gases from the first stage with excess air.

In the method of this invention, the rates of primary airflow to the first stage and secondary airflow to the second stage are determined, and the primary airflow is controlled to maintain the ratio of primary airflow rate to total airflow rate less than a predetermined value of $$\frac{100\,N}{100 + \text{Percent Excess Air To Furnace}}$$

where N is a number between zero and unity.

In the preferred embodiment, N lies between 0.2 and 0.8.

The Percent Excess Air To Furnace is determined by measurement of the oxygen concentration in the flue gases from the second stage.

DESCRIPTION OF THE PREFERRED EMBODIMENT

Figure 1:
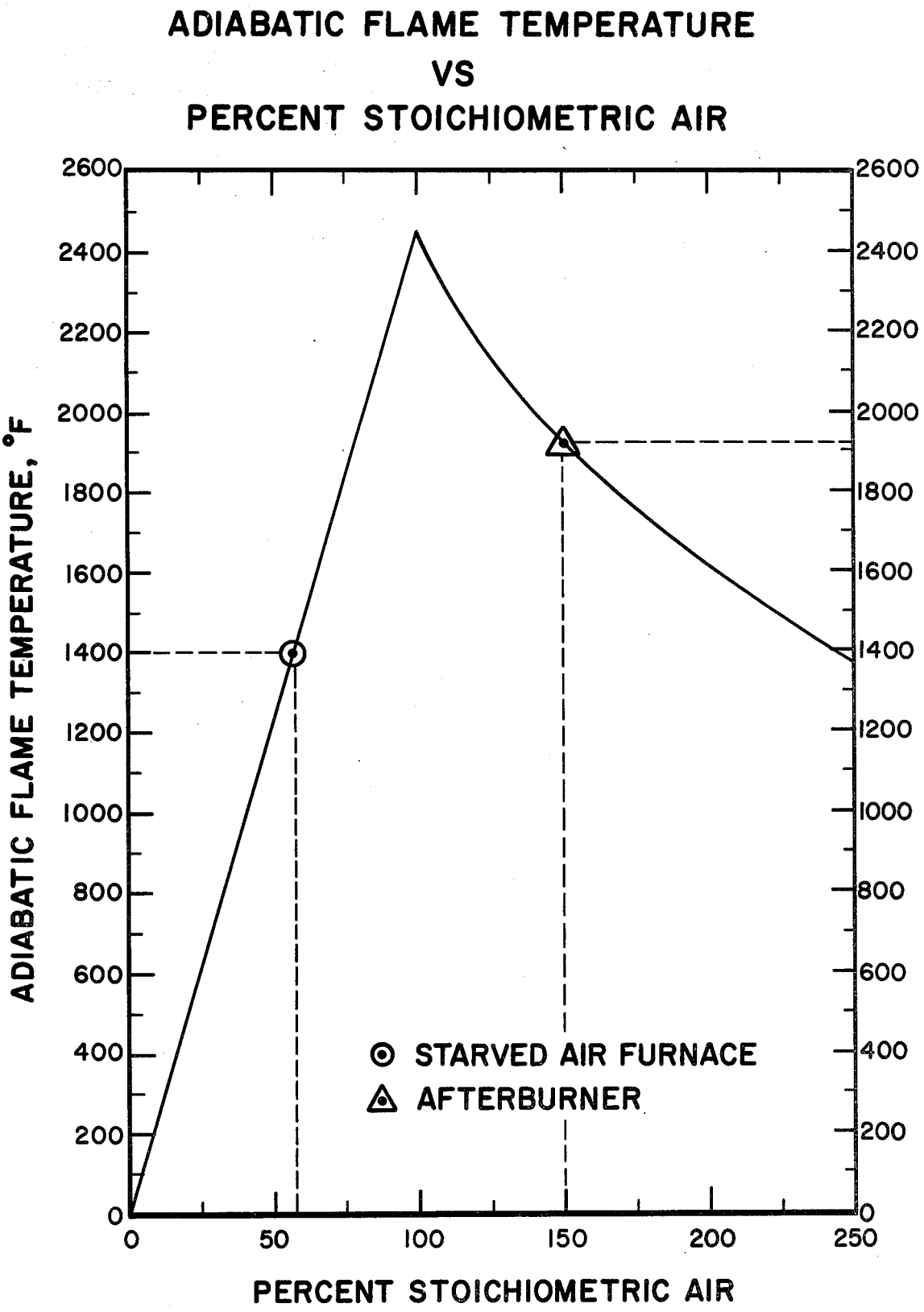
FIG. 1 is a graphical representation of the adiabatic flame temperature in a furnace as a function of the air quantity supplied.

Referring now to FIG. 1, which illustrates the relationship of air rate to adiabatic flame temperature in two-stage combustion, we see that for a given adiabatic flame temperature, there are two possible air rates, one substoichiometric and one superstoichiometric. (at 100 percent stoichiometric air, there is a single adiabatic flame temperature). Thus, simple temperture control does not ensure operation under substoichiometric conditions.

However, it can be shown that the residual oxygen concentration in flue gases from the second stage is related to the overall percent of stoichiometric air added. For example, if air is added at 150 percent of the stoichiometric quantity, (50 percent excess air) the residual oxygen concentration will be about 7 percent on a dry basis.

Figure 2:
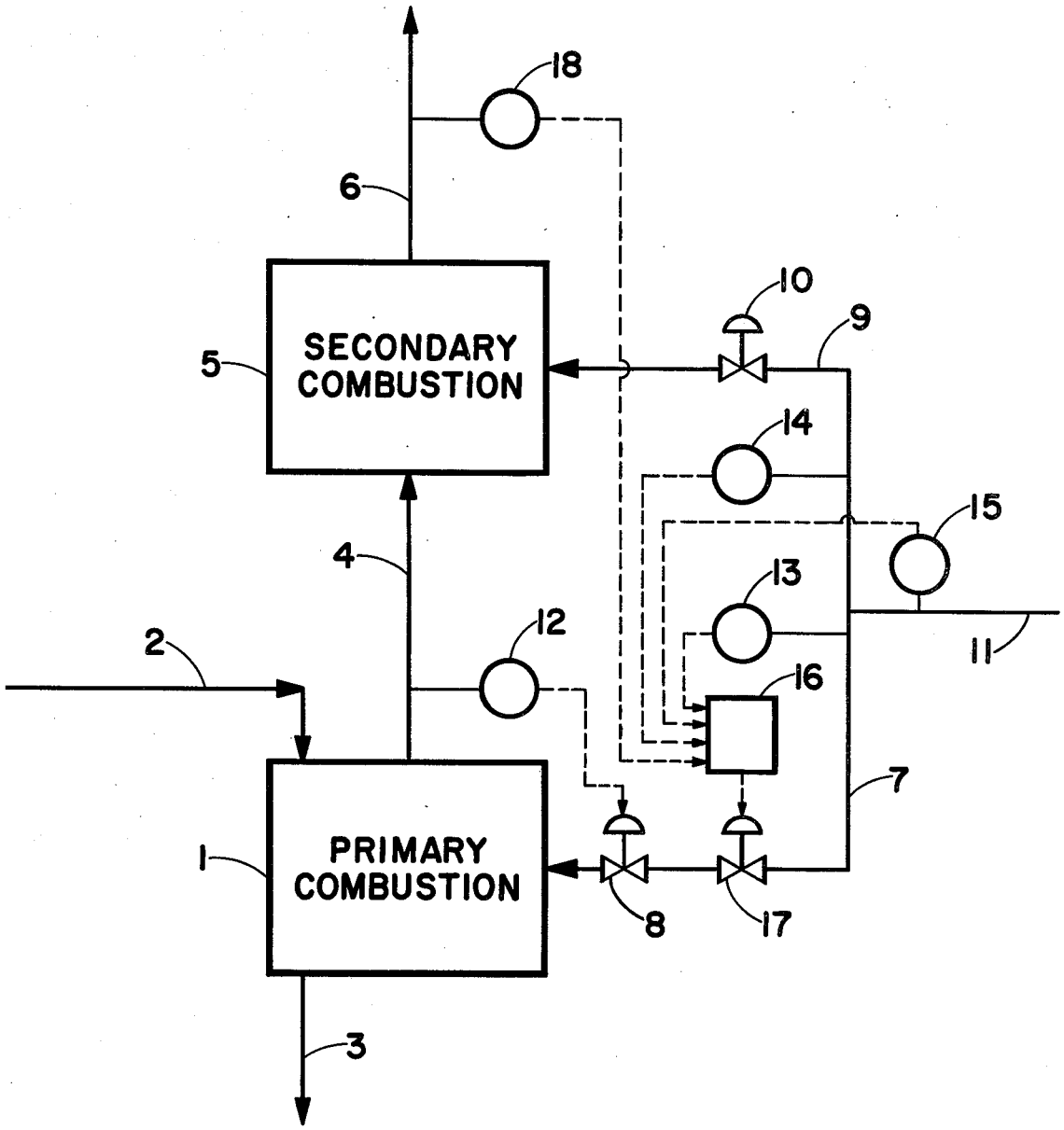
FIG. 2 is a schematic diagram of the invention.

The invention of the present application is shown schematically in FIG. 2, where primary combustion of combustible material 2 with sub-stoichiometric quantities of oxygen is performed in first stage 1 of a two-stage furnace. Gases 4 from the first stage 1 pass to the second stage combustion chamber 5 and are combusted with an excess of air 9 to produce flue gas 6.

An auxiliary fuel such as fuel oil or natural gas may be burned in either or both stages to aid in maintaining the desired temperatures. Such burners are not shown in FIG. 2.

A controller 12 actuates primary airflow valve or damper 8 to achieve the desired first stage temperatures.

The rate of airflow 9 to the second stage 5 is generally controlled by valve or damper 10 actuated by a temperature controller, not shown. Oxygen measurement by instrument 18 may be used to override normal control when the oxygen content of flue gas 6 drops below a predetermined value.

In an alternate control scheme, the air flow 9 is normally controlled to yield a predetermined oxygen content in flue gas 6 and temperature measurement may be used to override normal control.

In either case the oxygen content of the flue gas is measured.

The method of this invention comprises measurement of at least two of the following three airflow rates:

a. rate of airflow 7 to first combustion stage 1, measured by flow rate instrument 13;
b. rate of airflow 9 to second combustion stage 5, measured by flow rate instrument 14; and
c. total rate of airflow 11 to both stages, measured by flow rate instrument 15. This is equivalent to the total of measured values in (a) and (b) above.

Signals from at least two of the three flow rate instruments and a signal from oxygen analyzer 18 are directed to controller 16 which actuates valve or damper 17 to reduce the rate of primary airflow 7 when the ratio of primary airflow rate to total airflow rate exceeds a predetermined value. This predetermined value is equal to $$\frac{100\,N}{100 + \text{Percent Excess Air}},$$

where N is a number between zero and unity and where Percent Excess Air is derived from the measured oxygen content (dry basis) of the flue gas 6 as $$\text{Percent Excess Air} = \frac{(100) \times (\text{Oxygen, \%})}{21 - (\text{Oxygen, \%})}$$

It can be seen that when the factor N is unity the first stage will be operating at 100 percent of stoichiometric air requirements. Generally it is desirable to prevent the first stage from attaining such a condition; therefore the controller 16 is preset to always maintain the primary airflow rate at a value somewhat less than stoichiometric. The particular value of N at which controller 16 is set depends upon the variability in moisture and organic composition of the feed combustibles, feed rate of combustibles, and furnace design, and may for instance be 0.8 with a wet feed material requiring much oxidation to maintain the proper primary combustion temperature. For a combustible material with high heating value, it may be desirable to operate at a lower value of N such as 0.4. While any value of N between zero and unity may be used, for most materials to be pyroprocessed the preferred valve of N lies between 0.2 and 0.8. It can be shown that N represents (Primary Airflow Rate)÷(Theoretical Airflow Rate Required for Complete Combustion of the Combustible Feed Material).

In many furnaces air is introduced to the primary or secondary combustion chamber in a plurality of streams. It is not necessary that every stream be measured and included in the air flow rate signals to controller 16, as long as the relationship of the signals to the total air rates to either or both chambes is known.

The control element of this invention is shown in FIG. 2 as a separate valve or damper 17 in series with the normal control valve or valves 8. The valve or damper 8 is controllably actuated by controller 16 to reduce the primary airflow rate. Alternatively, an override of the normal temperature control signal from controller 12 to valve 8 by a signal from controller 16 will tend to close valve 8 to reduce the primary airflow rate.

Regardless of which valve is actuated, the control method of this invention becomes operative only when the ratio of primary airflow to total airflow attains a value equal to $$\frac{100\,N}{100 + \text{Percent Excess Air To Furnace}}.$$

This invention may be applied to a two-stage furnace where the second stage is an integral structural part of the first stage. Examples of such construction are (a) a multiple hearth furnace where the uppermost hearth space is used as the second stage and combustible materials are fed on the next lower or a further lower hearth, and (b) a fluidized bed incinerator where the uppermost portion of the chamber comprises the second stage.

In other applications the first and second stages are structurally separate. The second stage in this case is termed an afterburner.

Controller 16 is a readily-available signal-producing instrument having addition and division capabilities.

Airflow rates may be determined by any of numerous flow measurement methods, for example by measuring pressure drop across an orifice.

Likewise, various instruments exist for measurement of oxygen concentration in gases. The measured oxygen concentration must be on the basis of dry air, or on an equivalent basis so that the relationship between measured oxygen and excess air is known.

In summary, the method of this invention readily controls a two-stage furnace to maintain the primary combustion in substoichiometric mode and the secondary combustion with excess air. Measuring instruments other than those already use for normal control of temperature and residual oxygen are not needed, and in fact, the need for measurement of the combustibles or oxygen content of gases from the first stage is usually eliminated.

I claim:

1. In an incineration process in a two-stage starved air combustion furnace wherein combustible material to be processed is partially combusted with primary air at substoichiometric rates in a first stage to produce gases which are combusted with a controlled superstoichiometric rate of secondary air in a second stage and discharged as flue gases, the improvement comprising the steps of:

a. determining the rates of primary airflow to said first stage and secondary airflow to said second stage;

b. measuring the oxygen concentration in said flue gases from said second stage;

c. determining the Percent Excess Air to Furnace from said measured oxygen concentration; and d. controlling said rate of said primary airflow in response to said determined rates of primary and secondary airflow and said Percent Excess Air to Furnace, to maintain the ratio of primary airflow to total airflow rate less than a predetermined value of $$\frac{100\,N}{100 + \text{Percent Excess Air To Furnace}}$$

where N is a number between 0.2 and 0.95 to maintain said primary airflow at a substoichinmetric rate.

2. The method according to claim 1, comprising controlling said rate of primary airflow by actuating a valve through which primary air passes, when said ratio of primary airflow rate to total airflow rate attains or exceeds said predetermined value.

3. The method according to claim 2, which comprises normally controlling said valve in response to first stage temperature and overriding said normal control to reduce primary airflow when said ratio attains or exceeds said predetermined value.

4. The method according to claim 1, wherein said incineration process in a two-stage starved air combustion furnace comprises combustion of gases in an uppermost hearth space of a multiple hearth furnace operated with controlled superstoichiometric air rate, said gases produced from combustible materials fed on the next lower or a further lower hearth.

5. The method according to claim 1, wherein said incineration process in a two-stage starved air combustion furnace comprises incineration of said combustible material in a multiple hearth furnace operated with substoichiometric air rate to produce gases which are combusted in an afterburner with controlled super-stoichiometric air rates.

* * * * *